United States Patent [19]

Jones et al.

[11] Patent Number: 4,752,982

[45] Date of Patent: Jun. 28, 1988

[54] ADJUSTABLE BACK SUPPORT APPARATUS

[76] Inventors: Jackson D. Jones, 4141 S. Seneca Apt. 602, Wichita, Kans. 67217; Michael K. Standifer, 248 Stearns, Haysville, Kans. 67060

[21] Appl. No.: 874,396

[22] Filed: Jun. 16, 1986

[51] Int. Cl.[4] ..... A47C 20/04

[52] U.S. Cl. ..... 5/433; 5/432

[58] Field of Search ..... 5/433, 432, 437, 465, 5/446, 436; 297/284, 392

[56] References Cited

U.S. PATENT DOCUMENTS

| | | | |
|---|---|---|---|
| 1,898,272 | 2/1933 | Stern | 5/432 |
| 2,992,435 | 7/1961 | De Rosa et al. | 5/432 |
| 3,197,255 | 7/1965 | Caudill | 5/432 |
| 3,596,990 | 8/1971 | Gottfried | 297/284 |
| 3,828,377 | 8/1974 | Fary, Sr. | 297/392 |
| 3,946,452 | 3/1976 | Eary, Sr. | 297/392 |
| 4,364,488 | 8/1982 | Eary, Sr. | 5/436 |
| 4,455,698 | 6/1984 | Eary, Sr. | 5/436 |
| 4,531,247 | 7/1985 | Eary, Sr. | 5/436 |
| 4,601,514 | 7/1986 | Meiller | 297/284 |

FOREIGN PATENT DOCUMENTS

| | | | |
|---|---|---|---|
| 1126148 | 6/1982 | Canada | 5/432 |
| 398246 | 9/1933 | United Kingdom | 5/433 |
| 1559797 | 1/1980 | United Kingdom | 5/433 |
| 1594741 | 8/1981 | United Kingdom | 5/432 |

*Primary Examiner*—Alexander Grosz
*Assistant Examiner*—Carl M. DeFranco, Jr.
*Attorney, Agent, or Firm*—Phillip A. Rein

[57] ABSTRACT

This invention relates to an adjustable back support apparatus having a main support base assembly; a main support and cushion assembly; and an anchor assembly to adjustably connect the main support and cushion assembly to the main support base assembly. The main support base assembly includes a support plate member having a cover plate member pivotally connected thereto to cover the adjustment features. The main support and cushion assembly includes a right panel member; a left panel member; and a central panel member, all independently adjustable to various positions to provide the desired support to person's back area. The anchor assembly includes bolt members extended through guide members on the support plate member and mounted within respective anchor nut members to achieve the desired adjustment result.

4 Claims, 2 Drawing Sheets

FIG. 1
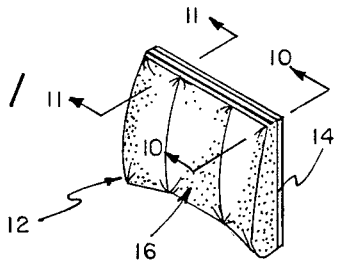
FIG. 2
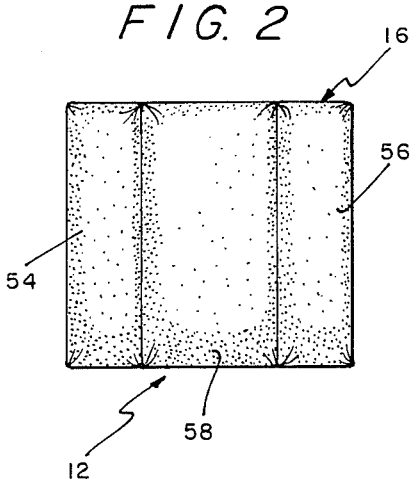
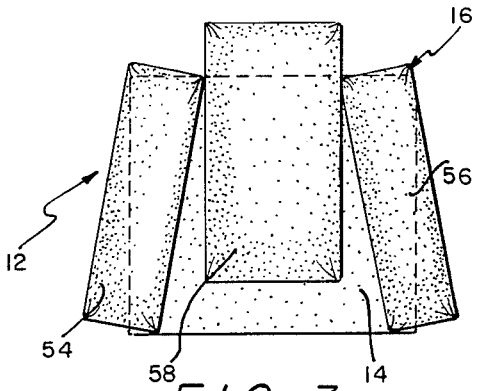
FIG. 3
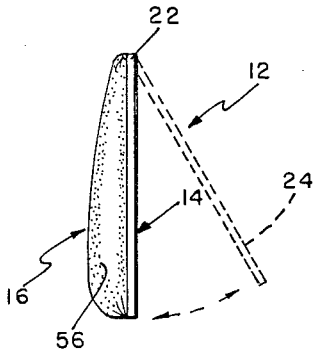
FIG. 4
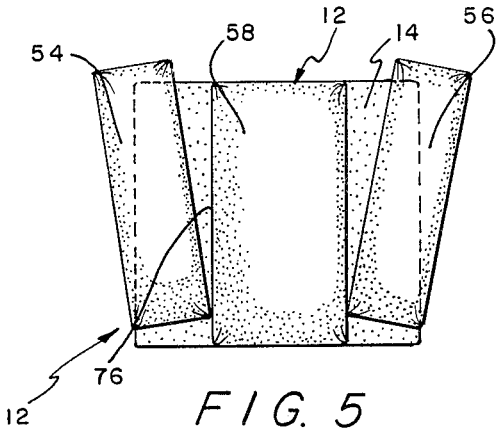
FIG. 5
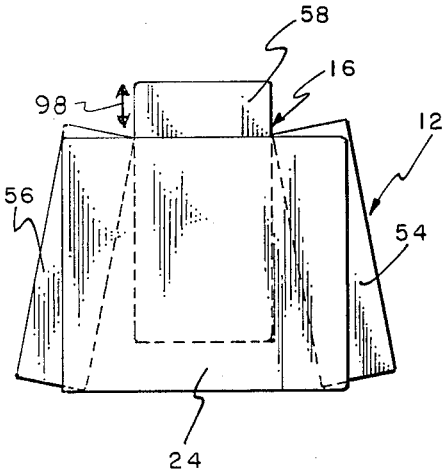
FIG. 6

ADJUSTABLE BACK SUPPORT APPARATUS

PRIOR ART

A patentability investigation on the above identified invention revealed the following United States patents:

| Reg. No. | Patent | Inventor |
|---|---|---|
| 3,305,878 | CUSHION CONSTRUCTION | Hellbaum |
| 3,828,377 | ADJUSTABLE BODY REST | Fary, Sr. |
| 3,849,810 | PILLOW | Degen |
| 4,346,488 | ADJUSTABLE UPPER BODY REST | Eary, Sr. |
| 4,455,698 | ADJUSTABLE UPPER BODY REST | Eary, Sr. |
| 4,531,247 | ADJUSTABLE UPPER BODY REST | Eary, Sr. |

It is seen that inventor, Eary, Sr., has numerous patents entitled "Adjustable Upper Body Rest" which are mainly utilized to provide support around the head portion of a person's body. These structures have numerous adjustable features but do not appear to be adjustable in a manner similar to our invention.

The Fary, Sr., patent discloses an adjustable body rest to support a face portion. FIGS. 1 and 3 indicate the use of a support cushion which is adjustable through the use of velcro fasteners into multiple adjustable positions.

The Hellbaum and Degen patents disclose cushion or pillow structures which are foldable and provided in three-way sections similar to our invention. However, the Hellbaum patent is merely foldable on its three sections and not fully adjustable. The Degen patent shows numerous embodiments but is not adjustable similar to our invention.

It is noted that numerous of the cited United States patents disclose adjustable body rests to receive and support the face portion of a person in a downwardly projected position required due to bodily injury. However, none of the references disclose a three-part support cushion assembly being adjustable in various directions to achieve the ultimate in body back support in areas of pain and discomfort which need to be supported.

PREFERRED EMBODIMENT OF THE INVENTION

In one preferred embodiment of this invention, an adjustable back support apparatus is provided including (1) a main support base assembly; (2) a main support and cushion assembly; and (3) an anchor assembly operable to adjustably connect the main support and cushion assembly to the main support base assembly. The main support base assembly includes a support plate member of generally rectangular or square shape having a cover plate member pivotally connected by a connector assembly to a support plate member. The support plate member is provided with left panel connector slots, right panel connector slots, and a central panel connector slots to receive and selective adjust corresponding panels from the main support and cushion assembly. The cover plate member includes a base member having an outer material covering thereon and is adapted to enclose and conceal the support plate member during usage thereof. The right and left panel connector slots are each provided with a main vertical slot and parallel lateral slots therefrom to achieve multiple adjustment features. The main support and cushion assembly includes a left panel member, a right panel member, and a central panel member. Each of the panel members is provided with a base support member having a plurality of connector holes therein; a main cushion body being a resilient material such as foam rubber or the like; and an outer cover member to enclose the main cushion body and provide an attractive appearance thereto. The anchor assembly includes a plurality of bolt members each associated with a washer member and anchor nut member. The anchor nut members are attached to a respective connector holes and the base support members of the right, left, and central panel members so as to receive a respective bolt member through a guide member. The right, left, and central panel members can be moved in multiple directions in the respective right, left, and central connector slots in the support plate member and anchored in a given adjusted position by the bolt members to achieve the new and novel overall operation of this invention.

OBJECTS OF THE INVENTION

One object of this invention is to provide an adjustable back support apparatus having a main support and cushion assembly consisting of three (3) independent panels which are adjustably connected to a main support base assembly whereupon the various panels can be adjusted in numerous directions so as to be customized and fit the particular back conditions of the person using same.

Still, another object of this invention is to provide an adjustable back support apparatus having a main support base assembly with a support plate member provided with left, right, and central connector slots; and a main support and cushion assembly provided with a right, left, and central panel members which are secured by an anchor assembly in a desired adjusted position within the respective connector slots in the support plate member.

Another object of this invention is to provide an adjustable back support apparatus having right, left, and central panel members which are adjustable in infinitely variable directions and each having an outer contour portion readily operable to fit a person's back portion to achieve the ultimate adjustment for a person's particular, specific body size and ailment.

Still, one further object of this invention is to provide an adjustable back support apparatus which is economical to manufacture, sturdy in construction, readily adjustable to fit the person's desired back support needs, and substantially maintenance free.

Various other objects, advantages, and features of the invention will become apparent to those skilled in the art from the following discussion, taken in conjunction with the accompanying drawings, in which:

FIGURES OF THE INVENTION

FIG. 1 is a perspective view of an adjustable back support apparatus of this invention;

FIG. 2 is a front elevational view thereof;

FIG. 3 is a front elevational view thereof showing cushion panel members thereof in various adjusted positions;

FIG. 4 is a side elevational view thereof showing a back access plate moving toward an open access position in dotted lines;

FIG. 5 is a front elevational view similar to FIG. 3 illustrating the cushion panel members in additional adjusted positions;

FIG. 6 is a rear elevational view of the adjustable back support apparatus as illustrated in FIG. 3;

Figure 7:
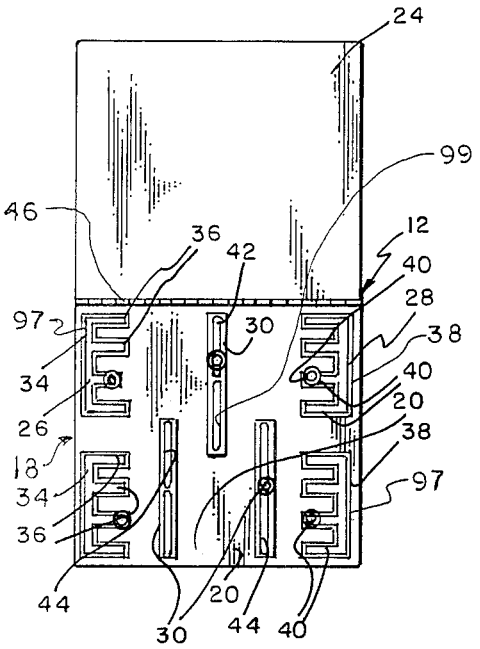
FIG. 7 is a rear elevational view of the adjustable back support apparatus with the back access plate positioned in an opened condition to reveal connector means therein.
Figure 8:
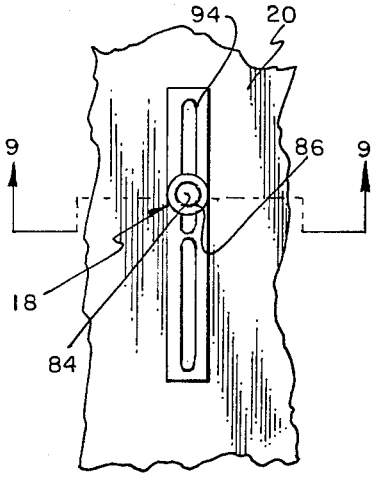
FIG. 8 is an enlarged fragmentary elevational view showing a portion of the connector means of this invention.

The following is a discussion and description of preferred specific embodiments of the new adjustable back support apparatus of this invention, such being made with reference to the drawings, whereupon the same reference numerals are used to indicate the same or similar parts and/or structure. It is to be understood that such discussion and description is not to unduly limit the scope of the invention.

DESCRIPTION OF THE INVENTION

On referring to the drawings in detail, an adjustable back support apparatus of this invention, indicated generally at 12, includes (1) a main support base assembly 14; (2) a main support and cushion assembly 16; and (3) an anchor assembly 18 to innerconnect the main support and cushion assembly or cushion support assembly 16 to the main support base assembly 14.

The main support base assembly 14 includes a support plate member 20 and a cover plate member 24 pivotally connected by a connector assembly 22 to the support plate member 20. The support plate member 20 is of a rectangular or square board a construction having thereon (1) left panel connector slots 26; (2) right panel connector slots 28; and (3) central panel connector slots 30.

The left panel connector slots 26 includes upper and lower vertical slots 34 each having a plurality of parallel lateral slots 36 associated therewith. It is seen that the upper and lower sections of the left panel connector slots 26 are identical in appearance and ressembly the letter "E" except having an additional leg thereon. It is obvious that the vertical slots 34 provides a continuous opening into the various lateral slots 36 for adjusting movement of a portion of the main support and cushion assembly 16 as will be explained.

The right panel connector slots 28 are substantially identical to the left panel connector slots 26 except extended in the opposite direction and including upper and lower vertical slots 38 each having a plurality of parallel lateral slots 40 associated therewith. The upper and lower right panel connector slots 28 are substantially identical to the left panel connect slots 26 except resemble a reverse letter "E" and operable to allow a portion of the main support and cushion assembly 16 to be adjusted in an infinite amount about vertical and horizontal axes as will be explained.

The central panel connector slots 20 includes an upper vertical slot 42 and lower parallel slots 44. The slots 42, 44 may be in half sections or continuous and extend in parallel planes to permit a portion of the main support and cushion assembly 16 to be adjusted in a manner to be explained.

As noted in FIGS. 3, 5 and 6, the main support and cushion assembly 16 includes (1) a right panel member 54; (2) a left panel member 56; and (3) a central panel member 58. The subject panel members 54, 56, and 58 are substantially identical in construction and vary in size and outer contour thereof.

Figure 11:
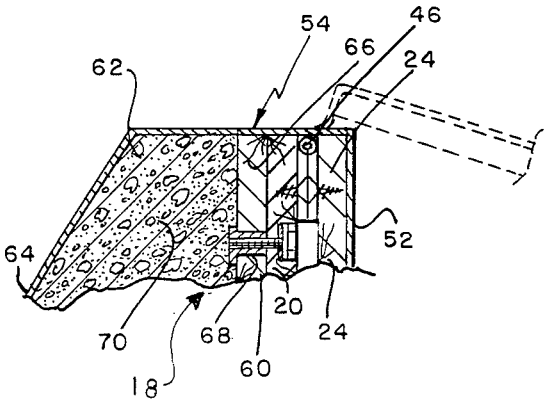
FIG. 11 is a view similar to FIG. 10 showing a portion of the back access plate movable to an open position in dotted lines.

As seen in FIG. 11, the right panel member 54 includes a base support member 60; a main cushion body 62 placed on the inside of the base support member 60; and an outer cover member 64 to enclose the main cushion body 62. The base support member 60 consists of board member 66 having at least two (2) spaced connector holes 68 therein.

The main cushion body 62 consists of a resilient member 70 being of a rubber or foam material to give the desired resiliency and support to the patient's back area utilizing same. As noted in FIG. 4, the main cushion body 62 may be of a tapered or arcuate configuration to provide the desired support in the back region.

Figure 10:
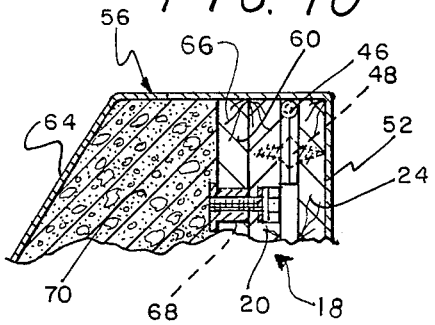
FIG. 10 is an enlarged fragmentary sectional view taken along line 10—10 in FIG. 1.

As noted in FIG. 10, the left panel member 56 is substantially similar to right panel member 54 except reversed in contour. The left panel member 56 includes a base support member 60; a main cushion body 62 mounted against one side of the base support member 60; and an outer cover member 64 to enclose the main cushion body 62. The base support member 60 includes the board member 66 with a pair of the spaced connector holes 68 therein.

The main cushion body 62 is provided with a contoured and resilient member 70 which may be arcuate and tapered as noted in FIGS. 1 and 4.

Figure 9:
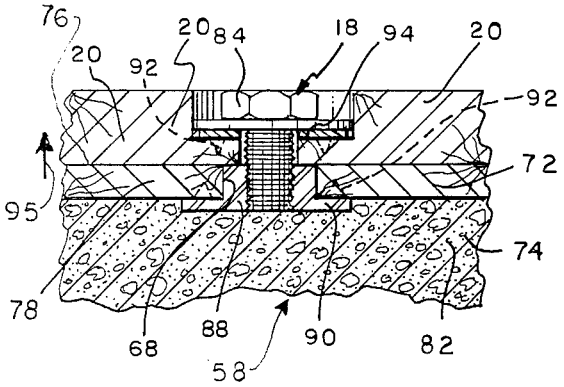
FIG. 9 is an enlarged fragmentary sectional view taken along line 9—9 in FIG. 8.

As noted in FIG. 9, the central panel member 58 includes a base support member 72 having a cushion member 74 mounted thereon and an exterior cover member 76 to enclose the cushion member 74. The base support member 72 includes a board element 78 having three (3) spaced connector holes 68 therein.

The cushion member 74 includes a resilient section 82 which may be contoured and arcuate shaped to conform to a lower back portion of a person utilizing the same.

It is noted that the base support member 72 is substantially the same length but double the width of the base support members 60 of the right and left panel members 54, 56. These provide substantial support to a person's back portion with the outer right and left panel members 54, 56 being adjustable in all directions.

As best shown in FIG. 9, the anchor assembly or connector means 18 utilizes the connector holes 68 in the main support and cushion assembly 16. The specific detail of each connector assembly of the anchor assembly 18 includes (1) a bolt member 84; (2) a washer member 86; (3) an anchor nut member 88; and (4) a metal guide member 94. Each bolt member 84 is provided with a conventional head section and external threads which are adapted to be received in internal threads of a respective anchor nut member 88. Each anchor nut member 88 is provided with a flange section 90 and projections 92 so as to be readily embedded and anchored against movement in the direction as noted by an arrow 95 in FIG. 9. An anchor nut member 88 is adapted to fit within respective connector holes 68 and so as to be readily connected by the bolt member 84 to the support plate member 20.

The metal guide member 94 is of an elongated shape constructed of plate material having a central groove 99 therein as noted in FIG. 7 to receive the respective bolt members 84 therein. An additional guide member 97 is provided to be placed about the left panel connector slots 26 and right panel connector slots 28 so as to provide a support surface to receive the washer members 86 and the bolt members 84 thereagainst.

The metal guide members 94 and 97 are provided with projections 92 thereon so as to be anchored in the support plate member 20 against lateral movement.

USE AND OPERATION OF THE INVENTION

In the use and operation of the adjustable back support apparatus 12 of this invention, it is obvious that the right panel member 54, the left panel member 56, and the central panel member 58 are connected to the main support base assembly 14 through the use of the anchor assembly 18 so as to form the assembled structure as noted in FIG. 2.

On proceeding with an adjustment operation, the cover plate member 24 is pivoted on the hinge member 46 and placed in the raised condition as shown in FIG. 7. At this time, it is seen that the numerous bolt members 84 are revealed in their respective metal guide members 94 and 97. On referring to the central panel member 58, it is noted that the bolt members 84 mounted therein can be loosened with a wrench member so that the central panel member 58 is adjustable in a longitudinal manner as shown by an arrow 98. On achieving an adjusted position which may be raised or lowered as shown in FIG. 6, the bolt members 84 in the connector holes 68 may be tightened down on the respective washer members 86 to hold the central panel member 58 in a desired adjusted position.

Next, the right panel member 54 may be adjusted by loosening the bolt members 84 therein and moving the panel member 54 to various possible positions as shown in FIGS. 3, 5, and 6. On reaching the desired adjusted position, the bolt members 84 can be tightened in their respective anchor nut members 88 to hold same in the adjusted position.

Finally, the bolt members 84 in the left panel member 56 are loosened whereupon the panel member 56 can be adjusted to various positions as shown in FIGS. 3, 5, and 6. On reaching the desired adjusted position, the respective bolt members 84 can be tightened on the washer members 86 to hold in the adjusted position.

After full adjustment, the cover plate member 24 can be pivoted about the hinge member 46 to the closed condition as noted in FIGS. 10 and 11.

It is important to note that the positioning and spacing of the bolt members 84 in the right and left panel members 54, 56 is such that the panel members have an infinite adjustment due to the substantial vertical slots 34, 38 and the plurality of lateral slots 40 to achieve the desired adjustments. This feature is true on both the right and left panel members 54, 56 so that any adjusted position can be obtained.

It is seen that the adjustable back support apparatus of this invention provides for three separately adjustable panel members to support the central and each side of the back portion of a person utilizing same. The back support apparatus is adjustable in multiple and infinite directions to achieve the required and independently desirable adjustments which can be readily changed to suit the person using same.

The adjustable back support apparatus of this invention is sturdy in construction; simple to adjust and anchor in the adjusted positions; attractive in appearance; economical to maintain; and easy to use.

While the invention has been described in conjunction with preferred specific embodiments thereof, it will be understood that this description is intended to illustrate and not to limit the scope of the invention which is defined by the following claims.

I claim:

1. An adjustable back support apparatus having a plurality of panel members that are adjustable to various positions to provide support to a person's back area, comprising:

(a) a support base assembly including a support plate member with right, left, and central panel connector slots therein;

(b) a support cushion assembly to support a lower back area of the person including having a right panel member, a left panel member, and a central panel member associated with respective ones of said right panel connector slots, said left panel connector slots, and said central panel connector slots;

(c) an anchor assembly being operably mounted on said support plate member, said anchor assembly extending through said right panel connector slots, said left panel connector slots, and said central panel connector slots and being attached to respective ones of said right, left, and central panel members to securely hold each of said panel members in a desired adjusted position against said support plate member;

(d) said right and left panel connector slots each having a vertical slot with lateral slots extending perpendicularly from said vertical slots, said right and left panel members being selectively and adjustably movable within the confines of said right and left panel connector slots, said central panel member being mounted between said right and left panel members and independently adjustable from a position abutting each of said right and left panel members to a desired support position; and (e) said vertical slot and said lateral slots together being of E-shape to permit movement of said anchor assembly therebetween.

2. An adjustable back support apparatus as described in claim 8, wherein:

(a) said central panel connector slots having a plurality of parallel vertical slots to provide for axial adjustment of said central panel member.

3. An adjustable back support apparatus as described in claim 1, wherein:

(a) said anchor assembly including E-shaped guide members secured to said support plate member and mounted about respective ones of said right and left panel connector slots;

(b) said anchor assembly including bolt members extended through said guide members and said support plate member and into said right, left, and central panel members to anchor same in a selected adjusted position;

(c) said anchor assembly including anchor nut members secured to said right, left, and central panel members to receive respective ones of said bolt members therein; and (d) said right panel member and said left panel member movable from a position adjacent said central panel member with said bolt members movable within said E-shaped guide members to provide infinite adjustment within the confines of said E-shaped guide members with a pair of said bolt members anchoring each of said left and right panel members.

4. An adjustable back support apparatus as described in claim 1, wherein:

(a) said cushion support assembly includes a cover plate member pivotally connected to said support plate member and operable to enclose and reveal said anchor assembly as necessary.

* * * * *